US010668740B2

(12) United States Patent
Kunioka

(10) Patent No.: US 10,668,740 B2
(45) Date of Patent: Jun. 2, 2020

(54) FABRIC PRINTING APPARATUS AND HEATING DEVICE

(71) Applicant: Ricoh Company, Ltd., Tokyo (JP)

(72) Inventor: Satoshi Kunioka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 211 days.

(21) Appl. No.: 15/783,492

(22) Filed: Oct. 13, 2017

(65) Prior Publication Data

US 2018/0147858 A1 May 31, 2018

(30) Foreign Application Priority Data

Nov. 25, 2016 (JP) ..... 2016-229322
Jun. 29, 2017 (JP) ..... 2017-127923

(51) Int. Cl.

| | |
|---|---|
| ***B41J 3/407*** | (2006.01) |
| ***B41F 16/02*** | (2006.01) |
| ***B41J 11/00*** | (2006.01) |
| ***B41K 3/44*** | (2006.01) |
| ***D06P 5/00*** | (2006.01) |

(52) U.S. Cl.
CPC ..... *B41J 3/4078* (2013.01); *B41F 16/02* (2013.01); *B41J 11/002* (2013.01); *B41K 3/44* (2013.01); *D06P 5/00* (2013.01)

(58) Field of Classification Search
CPC ..... B41J 3/4078
USPC ..... 101/407.1
See application file for complete search history.

(56) References Cited

U.S. PATENT DOCUMENTS 4,774,778 A * 10/1988 Williams ..... D05C 9/04 112/78
5,450,155 A * 9/1995 Carmen ..... G03D 5/065 396/636
6,764,237 B2 * 7/2004 Itou ..... B41J 11/66 400/621

(Continued)

FOREIGN PATENT DOCUMENTS

CN 1289293 A 3/2001
CN 102529426 A 7/2012

(Continued)

OTHER PUBLICATIONS

Combined Chinese Office Action and Search Report dated Feb. 19, 2019 in Patent Application No. 201711181790.8 (with English translation of Categories of Cited Documents), 10 pages.

(Continued)

*Primary Examiner* — Anthony H Nguyen
(74) *Attorney, Agent, or Firm* — Xsensus LLP

(57) ABSTRACT

A fabric printing apparatus includes a body and a cloth holder that holds a cloth and is movable in a moving direction. A receiver is disposed inside the body. The receiver removably holds the cloth holder. A printing device prints an image on the cloth placed on the cloth holder held by the receiver. A guide rail is mounted on both lateral ends of one of the cloth holder and the receiver in a direction perpendicular to the moving direction of the cloth holder. The guide rail engages and holds both lateral ends of another one of the cloth holder and the receiver in the direction perpendicular to the moving direction of the cloth holder.

16 Claims, 10 Drawing Sheets

(56) References Cited

U.S. PATENT DOCUMENTS

| | | | | |
|---|---|---|---|---|
| 7,040,748 | B2 * | 5/2006 | Niimi | B41J 2/01 101/126 |
| 8,265,524 | B2 * | 9/2012 | Hatayama | G03G 21/12 399/123 |
| 8,726,488 | B2 * | 5/2014 | Zadesky | H04M 1/0202 29/592.1 |
| 2002/0060728 | A1 | 5/2002 | Koizumi et al. | |
| 2003/0197772 | A1 | 10/2003 | Iwatsuki et al. | |
| 2004/0179047 | A1 | 9/2004 | Niimi | |
| 2004/0179081 | A1 | 9/2004 | Nimi et al. | |
| 2004/0189776 | A1 | 9/2004 | Niimi et al. | |
| 2005/0178309 | A1 * | 8/2005 | Yamada | B41J 3/4078 112/470.05 |
| 2009/0041525 | A1 | 2/2009 | Kunioka | |
| 2009/0056582 | A1 * | 3/2009 | Mizutani | B41J 3/4078 101/484 |
| 2010/0018424 | A1 * | 1/2010 | Faist | B41F 27/1206 101/477 |
| 2011/0109037 | A1 | 5/2011 | Kunioka | |
| 2012/0313310 | A1 | 12/2012 | Kunioka | |
| 2013/0134660 | A1 | 5/2013 | Idehara et al. | |
| 2014/0010575 | A1 | 1/2014 | Sakuma et al. | |
| 2016/0009109 | A1 | 1/2016 | Yanagishita | |
| 2016/0250863 | A1 | 9/2016 | Livingston | |
| 2017/0129181 | A1 | 5/2017 | Kunioka | |
| 2017/0210068 | A1 | 7/2017 | Kunioka | |

FOREIGN PATENT DOCUMENTS

| | | | |
|---|---|---|---|
| CN | 103129174 | A | 6/2013 |
| CN | 203331588 | U | 12/2013 |
| CN | 104943369 | A | 9/2015 |
| CN | 105793042 | A | 7/2016 |
| JP | 10-58661 | A | 3/1998 |
| JP | 2002-154247 | | 5/2002 |
| JP | 2004-268506 | | 9/2004 |
| JP | 2010-059998 | | 3/2010 |
| JP | 2013-96036 | A | 5/2013 |
| JP | 2013-112508 | | 6/2013 |

OTHER PUBLICATIONS

Chinese Office Action dated Feb. 27, 2020, issued in corresponding Chinese Patent Application No. CN201711181790.8, 6 pages.

* cited by examiner

FABRIC PRINTING APPARATUS AND HEATING DEVICE

CROSS-REFERENCE TO RELATED APPLICATIONS

This patent application is based on and claims priority pursuant to 35 U.S.C. § 119 to Japanese Patent Application Nos. 2016-229322, filed on Nov. 25, 2016, and 2017-127923, filed on Jun. 29, 2017, in the Japanese Patent Office, the entire disclosure of each of which is hereby incorporated by reference herein.

BACKGROUND

Technical Field

Exemplary aspects of the present disclosure relate to a fabric printing apparatus and a heating device, and more particularly, to a fabric printing apparatus for printing an image on fabric and a heating device for heating the image on the fabric.

Description of the Background

Related-art fabric printing apparatuses, such as a fabric printer, print on fabric and includes a medium conveyer and a securing structure. The medium conveyer reciprocally moves linearly. The securing structure supports the medium conveyer and produces a space that accommodates the medium conveyer. The securing structure includes a head that forms an image on fabric. While a power supply of the fabric printer is turned off, the medium conveyer is situated within a span of the securing structure in a moving direction of the medium conveyer. While a user places fabric on the medium conveyer and removes the fabric from the medium conveyer, the medium conveyer partially projects beyond the span of the securing structure in the moving direction of the medium conveyer.

If an upper face of the medium conveyer is entirely exposed to allow the user to place the fabric thereon, the user sets the fabric on the medium conveyer readily. However, the medium conveyer may partially project beyond the securing structure, upsizing the fabric printer.

Conversely, if the medium conveyer is partially exposed to allow the user to place the fabric thereon to prevent the medium conveyer from projecting beyond the securing structure and therefore downsize the fabric printer, a part of the medium conveyer may not be visible to the user, degrading usability of the fabric printer. Accordingly, the user may not set the fabric on a whole face of the medium conveyer without creasing the fabric.

SUMMARY

This specification describes below an improved fabric printing apparatus. In one embodiment, the fabric printing apparatus includes a body and a cloth holder that holds a cloth and is movable in a moving direction. A receiver is disposed inside the body. The receiver removably holds the cloth holder. A printing device prints an image on the cloth placed on the cloth holder held by the receiver. A guide rail is mounted on both lateral ends of one of the cloth holder and the receiver in a direction perpendicular to the moving direction of the cloth holder. The guide rail engages and holds both lateral ends of another one of the cloth holder and the receiver in the direction perpendicular to the moving direction of the cloth holder.

This specification further describes an improved heating device. In one embodiment, the heating device heats a cloth bearing an image printed by a fabric printing apparatus. The heating device includes a body and a receiver disposed inside the body. A cloth holder holds the cloth. The cloth holder is movable in a moving direction and removably attached to the receiver. A heater heats the cloth. A guide rail is mounted on both lateral ends of one of the cloth holder and the receiver in a direction perpendicular to the moving direction of the cloth holder. The guide rail movably engages and holds both lateral ends of another one of the cloth holder and the receiver in the direction perpendicular to the moving direction of the cloth holder.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
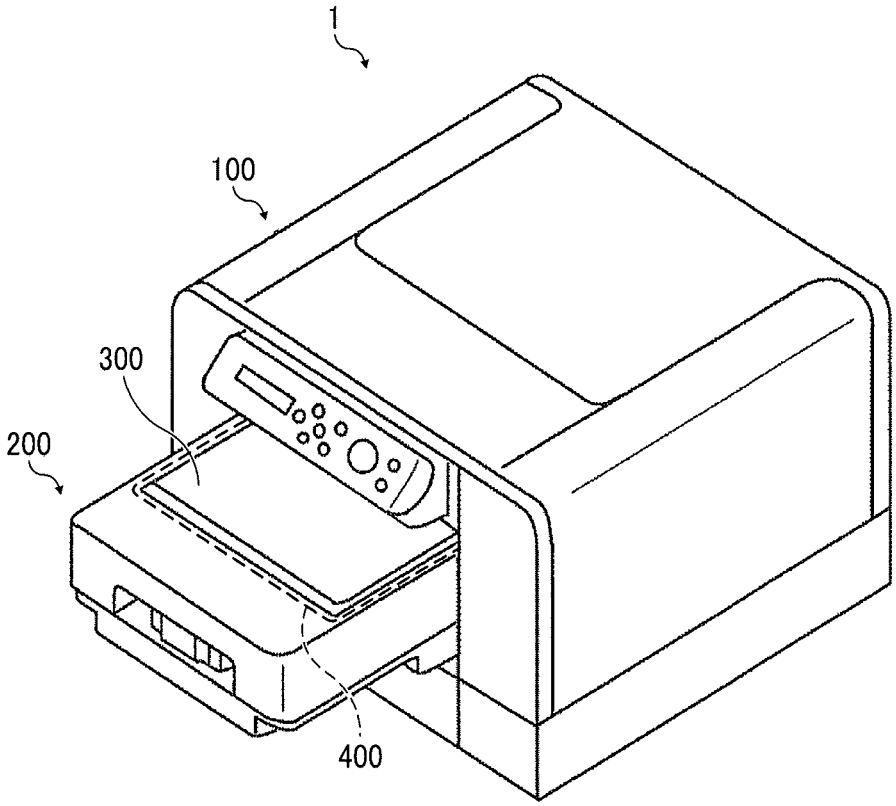
FIG. 1 is an external perspective view of a printer according to an embodiment of the present disclosure, illustrating a cassette attached thereto.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, a printer 1 according to an embodiment is explained.

Referring to FIGS. 1 to 4, a description is provided of a construction of the printer 1 according to a first embodiment of the present disclosure.

Figure 2:
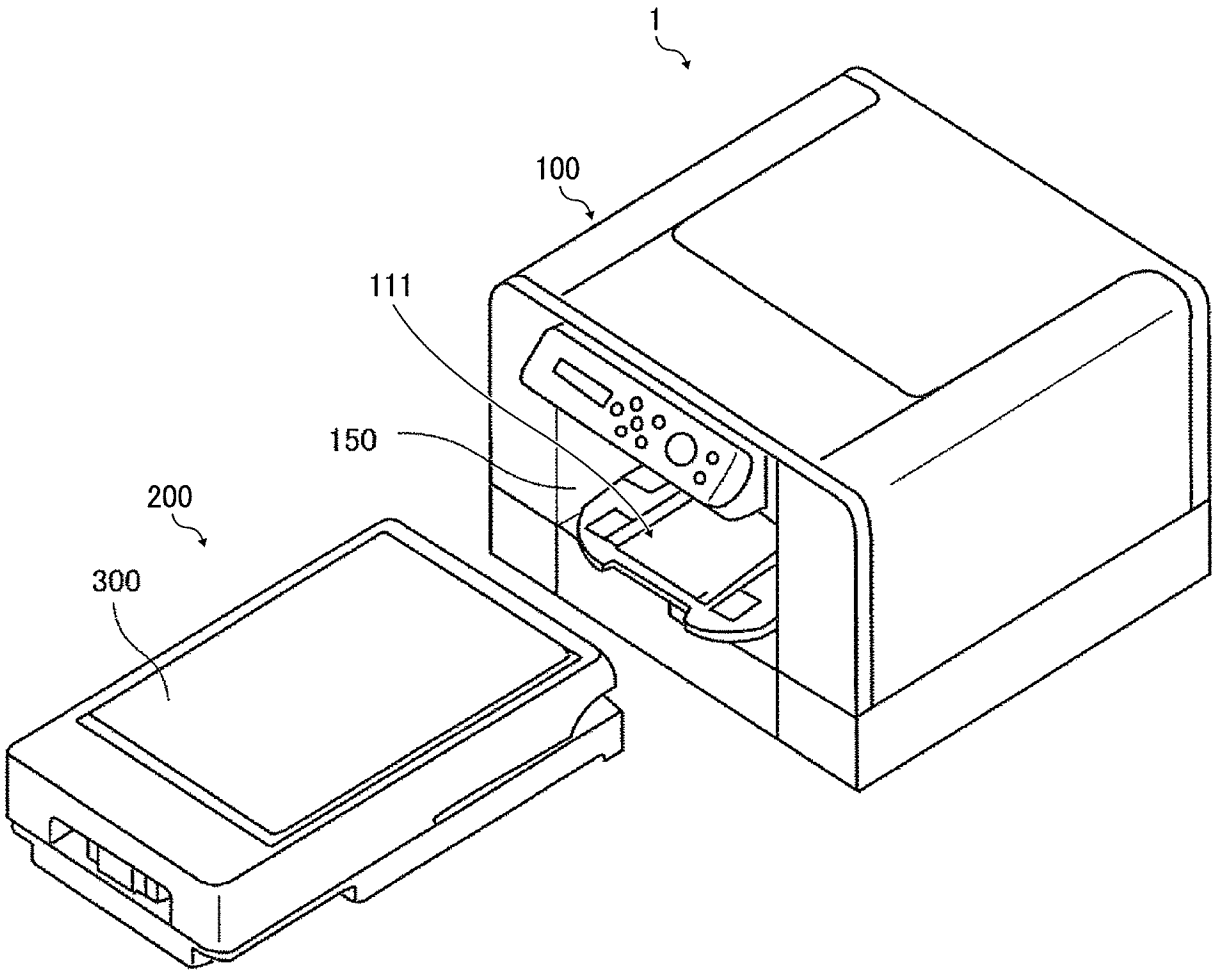
FIG. 2 is an external perspective view of the printer depicted in FIG. 1, illustrating the cassette removed therefrom.
Figure 3:
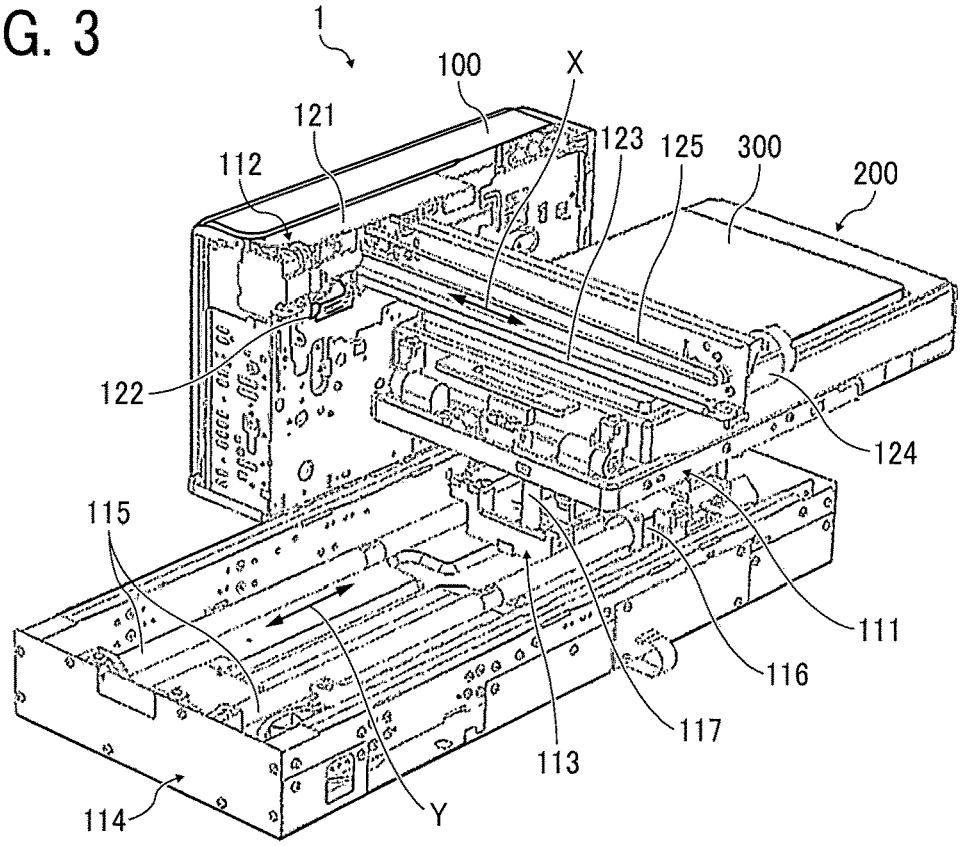
FIG. 3 is an internal perspective view of the printer depicted in FIG. 2, illustrating an entire mechanical section thereof seen from a first direction.
Figure 4:
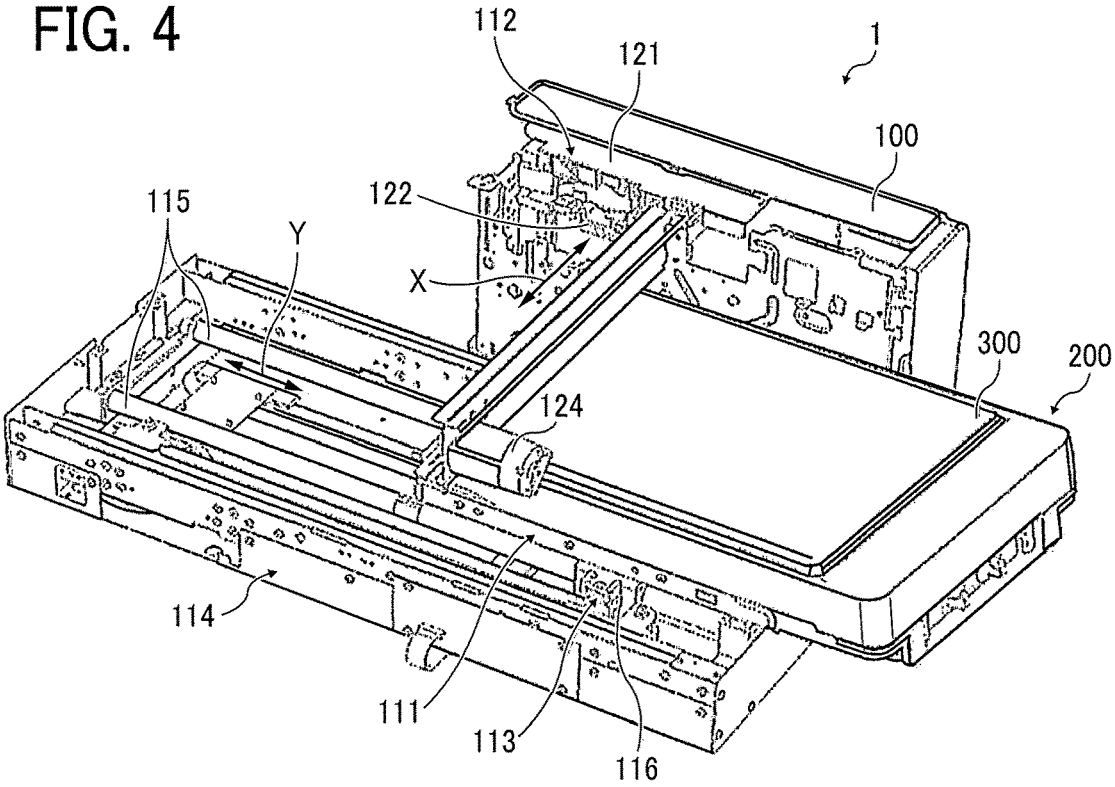
FIG. 4 is an internal perspective view of the printer depicted in FIG. 3, illustrating the entire mechanical section thereof seen from a second direction different from the first direction in FIG. 3.

The printer 1 is a fabric printer serving as a fabric printing apparatus that prints on fabric. FIG. 1 is an external perspective view of the printer 1 attached with a cassette 200. FIG. 2 is an external perspective view of the printer 1 and the cassette 200 removed from the printer 1. FIG. 3 is an internal perspective view of the printer 1, illustrating an entire mechanical section thereof seen from a first direction. FIG. 4 is an internal perspective view of the printer 1, illustrating the entire mechanical section thereof seen from a second direction different from the first direction in FIG. 3.

As illustrated in FIGS. 1 to 4, the printer 1 serving as a fabric printing apparatus includes a body 100. Inside the body 100 are the cassette 200, a stage 111, and a printing device 112. As illustrated in FIG. 1, the cassette 200 serving as a cloth holder is a tray that holds a cloth 400. As illustrated in FIG. 2, the stage 111 serves as a receiver that removably holds the cassette 200 and is movable back and forth. As illustrated in FIG. 3, the printing device 112 prints an image on the cloth 400 placed on the cassette 200 held by the stage 111.

For example, the cloth 400 includes a piece of cloth such as a handkerchief and towel, a fabric manufactured as clothes such as a T-shirt and a sweatshirt, and a fabric used as a part of a product such as a tote bag.

As illustrated in FIG. 3, the stage 111 is disposed above a conveyer 113 movably supported by the body 100 such that the conveyer 113 is movable in a direction Y, that is, a feed direction. The body 100 includes a bottom frame 114 that mounts a conveyance guide 115 along the direction Y. The conveyance guide 115 movably supports a slider 116 of the conveyer 113. The stage 111 is disposed on the conveyer 113 through a rod 117 that lifts and lowers the stage 111. Thus, a gap between the stage 111 and a head 122 of the printing device 112 is adjusted.

The printing device 112 includes a carriage 121 and the head 122. The carriage 121 moves relative to the stage 111 in a direction X, that is, a main scanning direction. The head 122 is mounted on the carriage 121. The carriage 121 is movably supported by a guide 123 extending in the direction X. A driving motor 124 reciprocally moves the carriage 121 in the direction X via a main scanning mechanical section such as a timing belt 125. The head 122 is a liquid discharge head that discharges ink onto a surface of the cloth 400 to form an image on the cloth 400. Alternatively, other types of heads may be employed as the head 122.

The cassette 200 includes a platen 300 on which the cloth 400 is placed. The cassette 200 mounting the cloth 400 is attached to the stage 111 that holds the cassette 200 inside the body 100. As the stage 111 moves in the direction Y and the head 122 reciprocally moves in the direction X repeatedly, the head 122 prints a desired image on the cloth 400.

Figure 5:
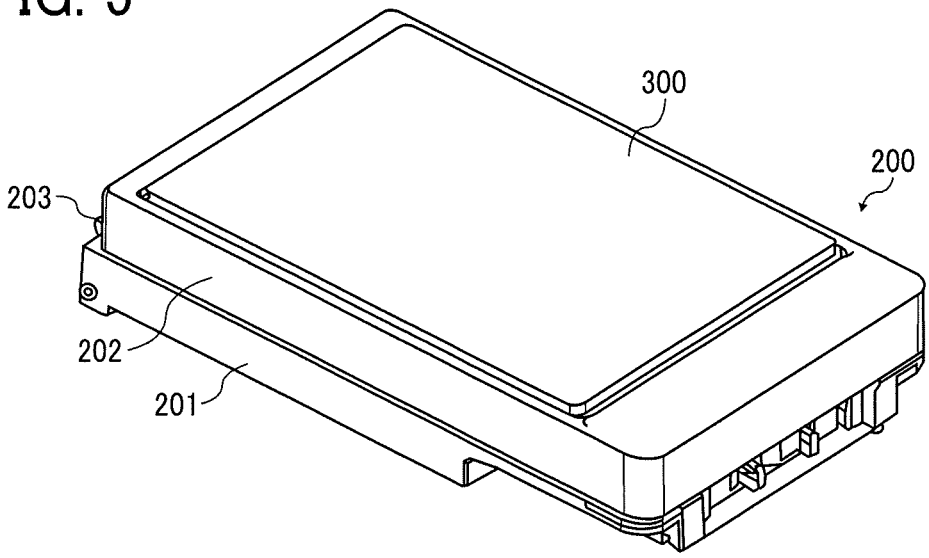
FIG. 5 is a perspective view of the cassette depicted in FIG. 2.
Figure 6:
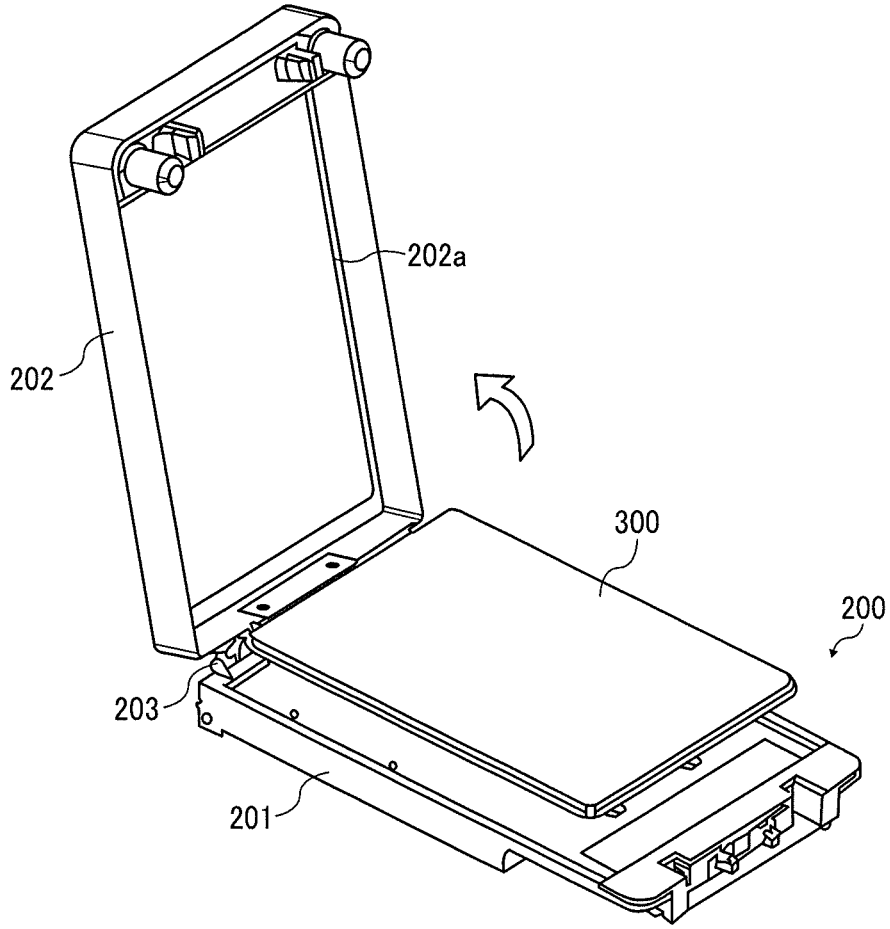
FIG. 6 is a perspective view of the cassette depicted in FIG. 5, illustrating a platen fringe cover that is lifted.
Figure 7:
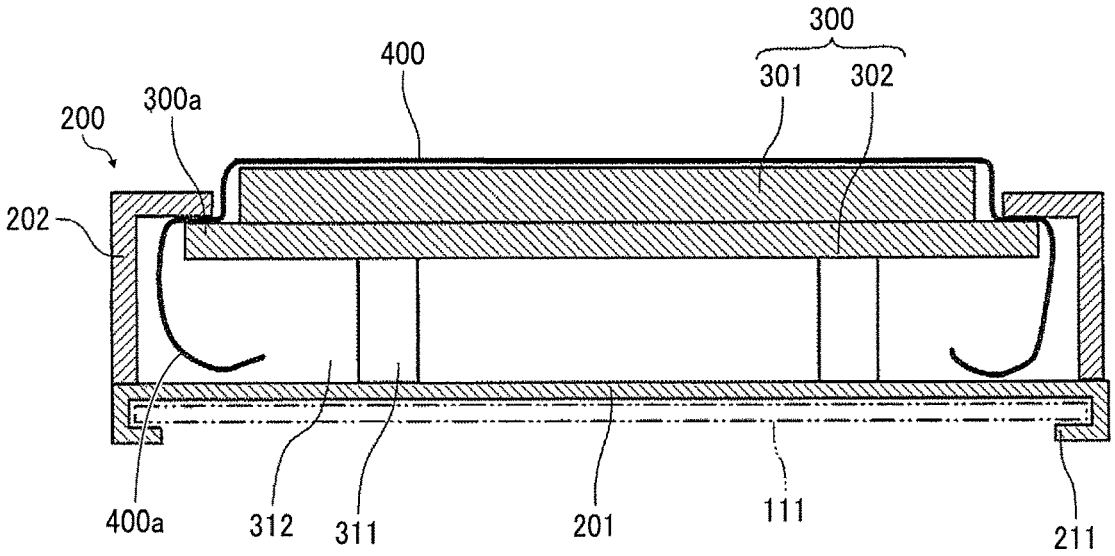
FIG. 7 is a schematic cross-sectional view of the cassette depicted in FIG. 5 in a short direction thereof.

Referring to FIGS. 5 to 7, a description is provided of a construction of the cassette 200 serving as a cloth holder.

FIG. 5 is a perspective view of the cassette 200. FIG. 6 is a perspective view of the cassette 200, illustrating a platen fringe cover 202 that is lifted. FIG. 7 is a schematic cross-sectional view of the cassette 200 in a short direction thereof.

As illustrated in FIG. 5, the cassette 200 includes a cassette base 201 serving as a base and the platen 300 that holds the cloth 400 and keeps a print portion of the cloth 400 where the image is printed to be planar.

As illustrated in FIG. 7, the platen 300 includes a platen base 302 and an insulator 301 that includes a mount face that mounts the cloth 400 and keeps the cloth 400 to be planar. The insulator 301 is resistant against heat generated by a heating device.

As illustrated in FIGS. 5 and 6, the cassette 200 includes the platen fringe cover 202 and a hinge 203. The platen fringe cover 202 serving as a fringe cover is attached to the cassette base 201 through the hinge 203 such that the platen fringe cover 202 is lifted in a direction indicated by an arrow in FIG. 6. As illustrated in FIG. 6, the platen fringe cover 202 includes a slot **202*a*, that is, an opening, disposed opposite the platen 300. As illustrated in FIG. 7, the platen 300 includes a flange 300*a* disposed at a rim of the platen 300. The platen fringe cover 202 presses the cloth 400 against the flange 300*a***.

A support 311 mounted on the cassette base 201 supports the platen 300. The platen 300 and the cassette base 201 define an accommodation chamber 312 (e.g., an accommodation space) that accommodates a surplus portion **400*a* of the cloth 400. For example, the surplus portion 400*a*** may be sleeves, a neck, a hem, and the like of a T-shirt, if an image is printed on a front of the T-shirt.

The platen 300 is removably attached to the cassette base 201 and is replaceable. Accordingly, a plurality of platens 300 may be used for printing. While a first platen 300 is used for a first print job, a user wraps a cloth around a second platen 300 to be used for a second print job. After the first print job and a fixing job are finished, the first platen 300 is replaced with the second platen 300 to start the second print job quickly.

In order to place the cloth 400 on the cassette 200, the user lifts the platen fringe cover 202 as illustrated in FIG. 6 and places the cloth 400 on the platen 300. In a state in which the accommodation chamber 312 accommodates the surplus portion **400*a* of the cloth 400 as illustrated in FIG. 7, the user lowers the platen fringe cover 202 as illustrated in FIG. 5**.

In order to print on the cloth 400, the cassette 200 mounting the cloth 400 is attached to or set onto the stage 111 disposed inside the body 100 of the printer 1.

As described above, the user removes the cassette 200 entirely from the body 100 and places the cloth 400, onto which the image is to be printed, on the platen 300 readily.

After the printer 1 finishes printing on the cloth 400, the user sets the cassette 200 mounting the cloth 400 into the heating device. The heating device fixes the image on the cloth 400 under heat.

Referring to FIGS. 8 to 11, a description is provided of a construction that removably attaches the cassette 200 serving as a cloth holder to the stage 111 serving as a receiver.

Figure 8:
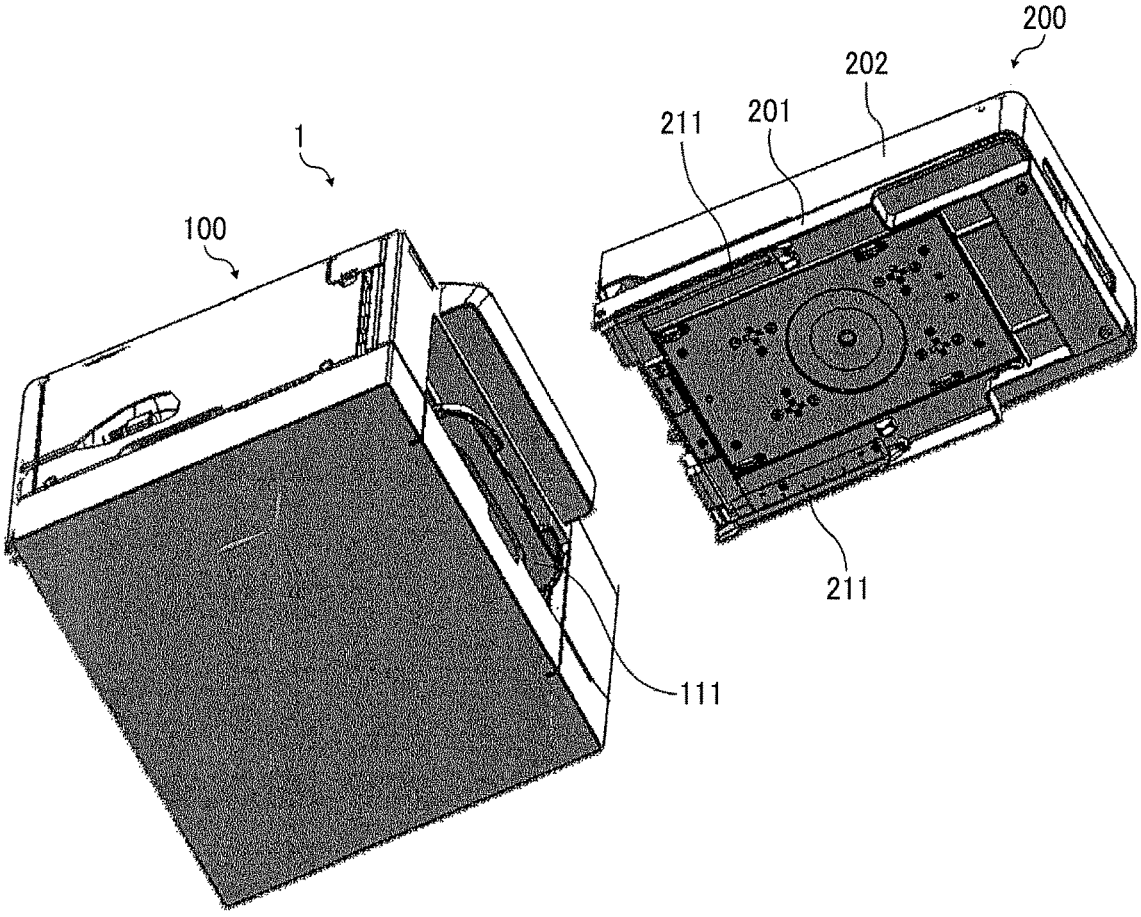
FIG. 8 is a perspective view of the cassette depicted in FIG. 2, illustrating a bottom thereof.
Figure 9:
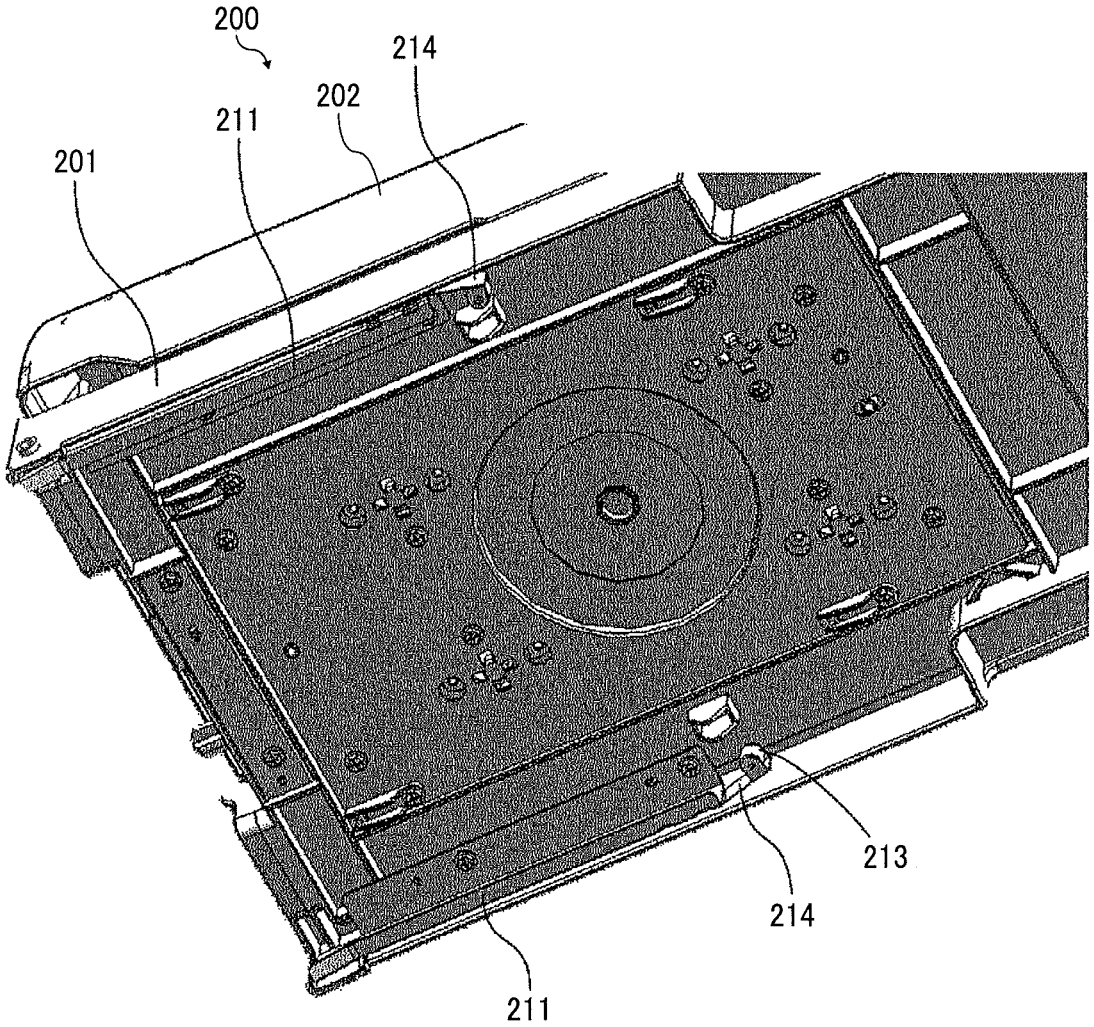
FIG. 9 is an enlarged perspective view of the cassette depicted in FIG. 8, illustrating the bottom thereof.
Figure 10:
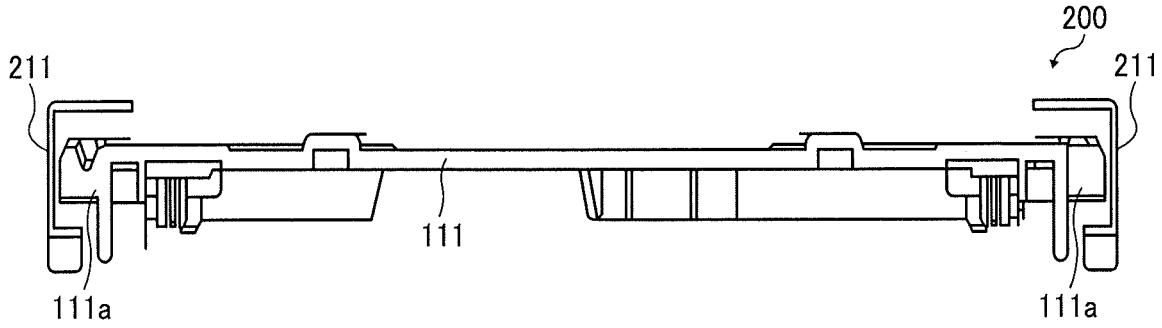
FIG. 10 is a front view of the cassette depicted in FIG. 9 attached to a stage.
Figure 11:
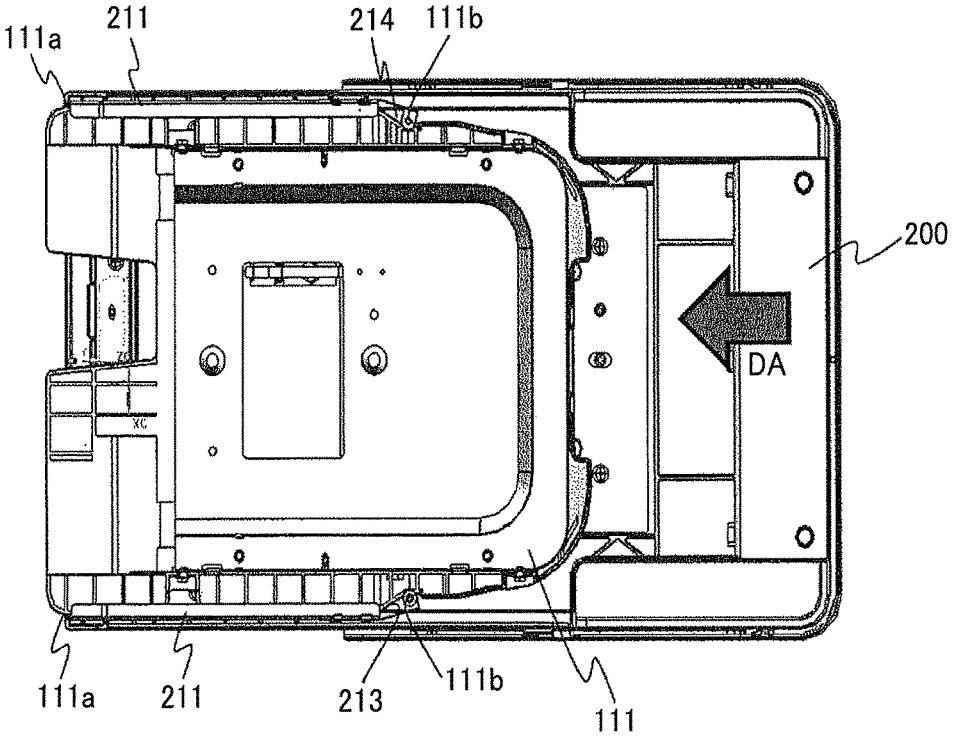
FIG. 11 is a plan view of the cassette depicted in FIG. 9 attached to the stage, illustrating the bottom of the cassette.

FIG. 8 is a perspective view of the cassette 200, illustrating a bottom thereof. FIG. 9 is an enlarged perspective view of the cassette 200, illustrating the bottom thereof. FIG. 10 is a front view of the cassette 200 attached to the stage 111. FIG. 11 is a plan view of the cassette 200 attached to the stage 111, illustrating the bottom of the cassette 200.

The cassette 200 is attached in an attachment direction DA in FIG. 11. The cassette 200 mounts guide rails 211 at both lateral ends of the cassette 200 in a direction perpendicular to the attachment direction DA. The guide rails 211 movably engage both lateral ends 111*a* of the stage 111 serving as a receiver in the direction perpendicular to the attachment direction DA such that the guide rails 211 hold the lateral ends 111*a*, respectively. The guide rail 211 holding the lateral end 111*a* denotes that the guide rail 211 covers three faces, that is, an upper face, a lower face, and a side face of the lateral end 111*a*.

Each of the lateral ends 111*a* of the stage 111 may be fitted into or engaged with the guide rail 211 entirely in the attachment direction DA. Alternatively, a projection locally disposed on each of the lateral ends 111*a* may be fitted into or engaged with the guide rail 211.

As described above, the guide rails 211 mounted on the cassette 200 movably engage the lateral ends 111*a* of the stage 111 such that the guide rails 211 hold the lateral ends 111*a*, respectively. Thus, the guide rails 211 reduce tilting of the cassette 200 relative to the stage 111 and rattling and backlash of the cassette 200.

The stage 111 mounts recesses 111*b* disposed opposite tailing ends of the cassette 200 in the attachment direction DA. The recesses 111*b* serve as a restraint that restricts motion of the cassette 200. Rollers 213 are disposed on trailing ends of the guide rails 211 mounted on the cassette 200 in the attachment direction DA, respectively. The rollers 213 serve as an engagement that separably engages the recesses 111*b* of the stage 111, respectively. The rollers 213 are supported by flat springs 214 serving as a resilient member, respectively. For example, the rollers 213 are held by the cassette 200 through the flat springs 214, respectively.

The recess 111*b* and the roller 213 construct a first restraint and a second restraint, respectively, that restrict an attachment position where the cassette 200 is attached to the stage 111.

The first restraint and the second restraint allow the user to attach the cassette 200 to a proper position on the stage 111 of the printer 1 readily.

The roller 213 supported by the flat spring 214 serving as a resilient member serves as an engagement. Accordingly, even after the rollers 213 engage the recesses 111*b*, respectively, the rollers 213 separate from the recesses 111*b* in a removal direction readily, facilitating removal of the cassette 200 from the stage 111.

Referring to FIGS. 12 to 16, a description is provided of a construction of a printer 1S according to a second embodiment.

Figure 12:
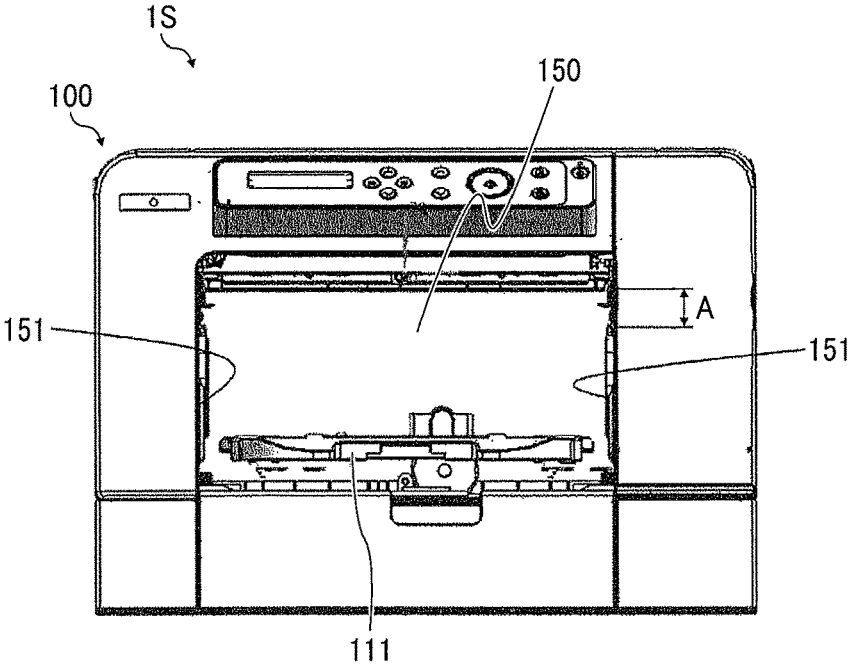
FIG. 12 is a front view of a printer according to a second embodiment of the present disclosure.
Figure 13:
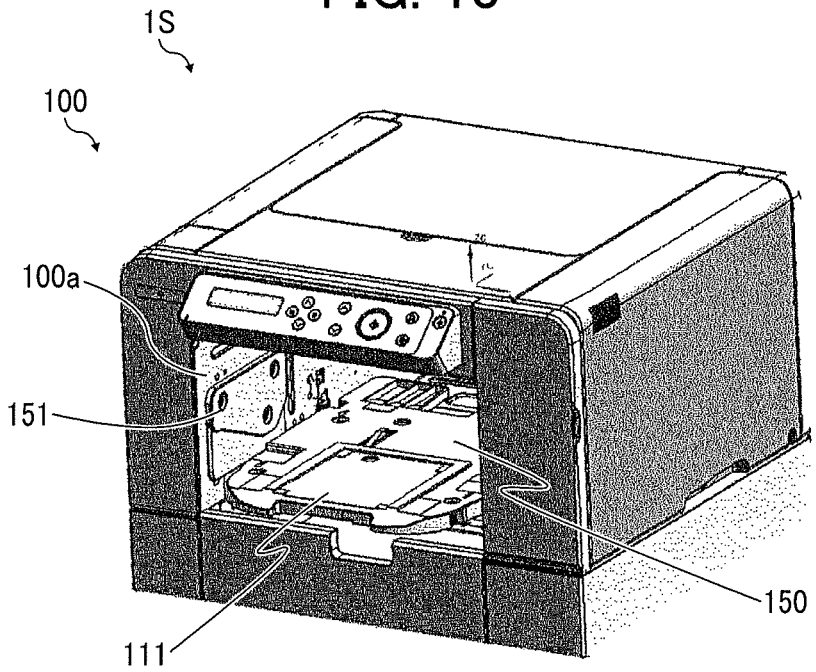
FIG. 13 is a perspective view of the printer depicted in FIG. 12, seen from a diagonally right point.
Figure 14:
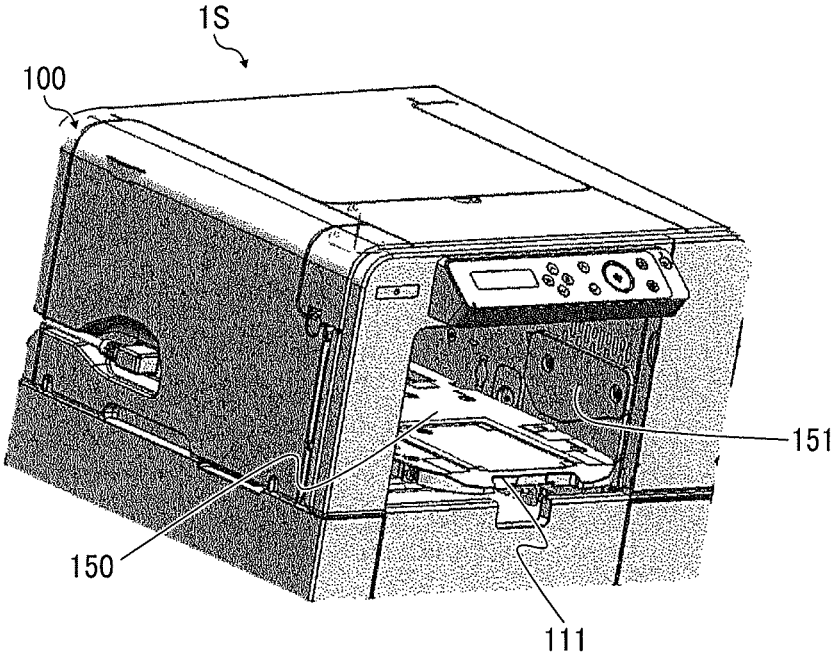
FIG. 14 is a perspective view of the printer depicted in FIG. 12, seen from a diagonally left point.
Figure 15:
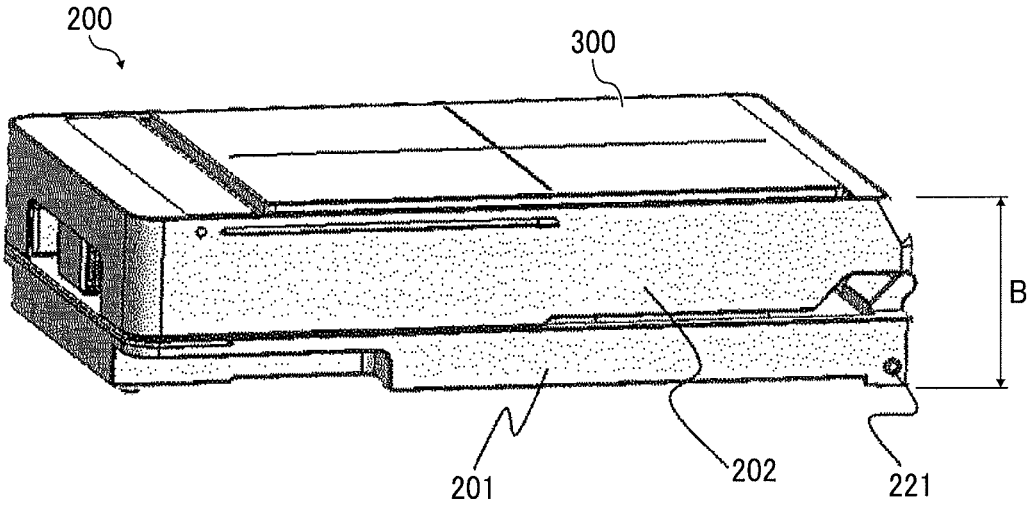
FIG. 15 is a perspective view of the cassette installable in the printer depicted in FIG. 12.
Figure 16:
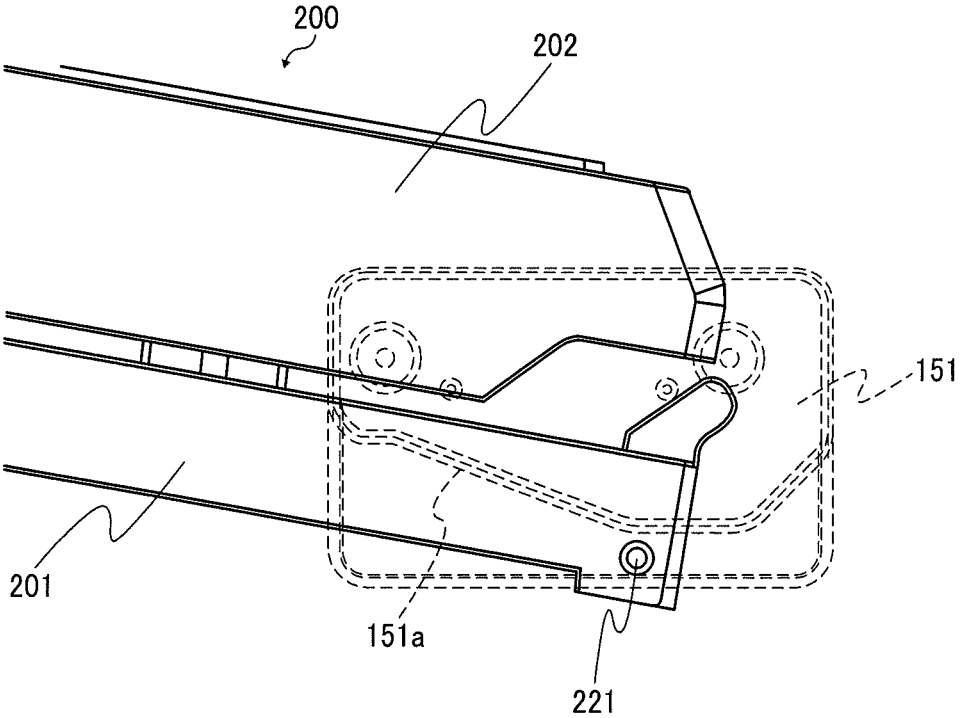
FIG. 16 is a side view of the cassette depicted in FIG. 15 being attached to a body of the printer depicted in FIG. 12.

FIG. 12 is a front view of the printer 1S according to a second embodiment. FIG. 13 is a perspective view of the printer 1S, seeing the printer 1S depicted in FIG. 12 from a diagonally right point. FIG. 14 is a perspective view of the printer 1S, seeing the printer 1S depicted in FIG. 12 from a diagonally left point. FIG. 15 is a perspective view of the cassette 200. FIG. 16 is a side view of the cassette 200 being attached to the body 100 of the printer 1S.

As illustrated in FIGS. 12 and 13, the printer 1S serving as a fabric printing apparatus includes guides 151 mounted on interior walls 100*a* of the body 100, respectively. The guides 151 guide the cassette 200 obliquely downward.

As illustrated in FIG. 15, projections 221 (e.g., bosses) are mounted on both side faces of the cassette base 201 of the cassette 200, respectively. As illustrated in FIG. 16, the guide 151 includes a guide face 151*a* that guides the projection 221.

In order to attach the cassette 200 to the stage 111 disposed inside the body 100, as illustrated in FIG. 16, the guide face 151*a* of the guide 151 guides the projection 221 of the cassette 200 obliquely downward toward the stage 111 while the projection 221 contacts a lower portion of the guide face 151*a*.

Accordingly, the guide faces 151*a* of the guides 151 smoothly guide the guide rails 211 of the cassette 200 to the lateral ends 111*a* of the stage 111 and fit the guide rails 211 into the lateral ends 111*a*, respectively, facilitating attachment of the cassette 200 to the stage 111 and enhancing usability of the printer 1S.

As illustrated in FIG. 12, each of the guides 151 is mounted on the interior wall 100*a* at a height where the guide 151 defines a distance A from a top face of the guide 151 to a top face of a cavity 150. The distance A is smaller than a height B of the cassette 200 depicted in FIG. 15.

Thus, the guides 151 prohibit the user from placing the cassette 200 at an erroneous position.

Figure 17:
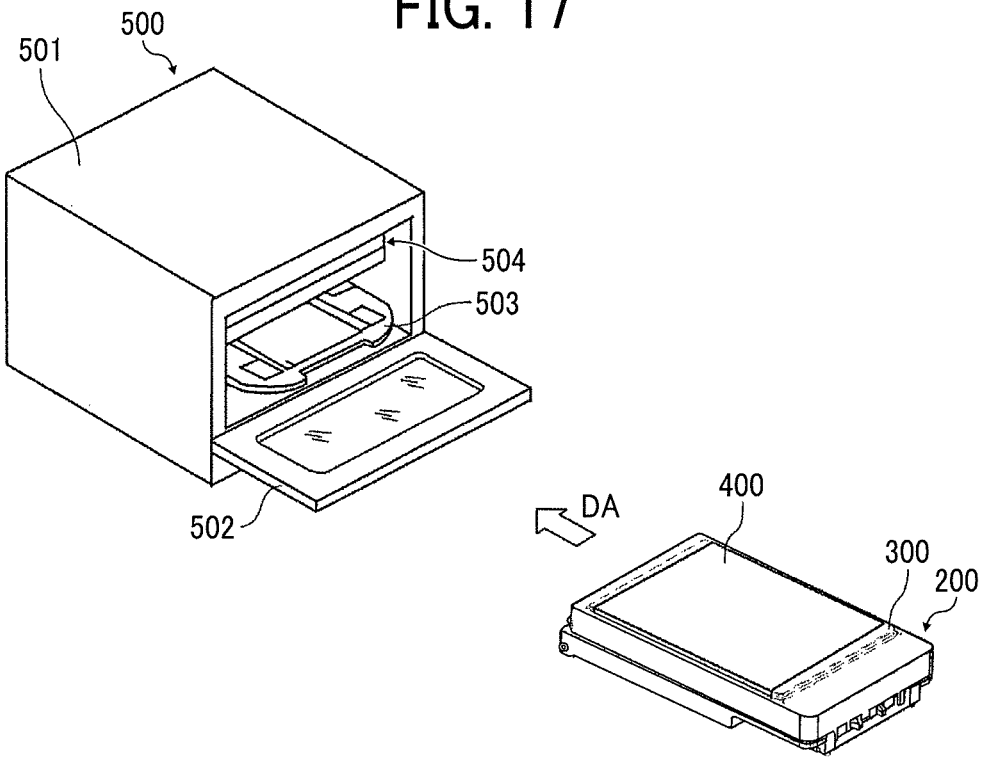
FIG. 17 is an external perspective view of a heating device.

Referring to FIG. 17, a description is provided of one example of a construction of a heating device 500 that heats the cloth 400.

FIG. 17 is an external perspective view of the heating device 500.

As illustrated in FIG. 17, the heating device 500 includes a body 501, a door 502, a receiver 503, and a heater 504. The receiver 503 and the heater 504 are disposed inside the body 501. The cassette 200 that holds the cloth 400 is removably attached to the receiver 503. The heater 504 heats the cloth 400.

The receiver 503 has a construction equivalent to the above-described construction of the stage 111 of the printer 1. After the printer 1 finishes printing on the cloth 400, the user sets the cassette 200 mounting the cloth 400 into the heating device 500.

With the above-described construction of the heating device 500, after the printer 1 finishes printing on the cloth 400, the user removes the cassette 200 mounting the cloth 400 from the printer 1. The user sets the cassette 200 mounting the cloth 400 onto the receiver 503 disposed inside the heating device 500. While the door 502 is closed, as power is supplied to the heater 504 to generate heat, the heater 504 heats the cloth 400 placed on the cassette 200 and fixes an image on the cloth 400.

A description is provided of processes for forming an image on a cloth 400.

In a holding process, the cassette 200 serving as a cloth holder holds a cloth 400. In a printing process, the cassette 200 mounting the cloth 400 is attached to the stage 111 of the printer 1 and the printer 1 prints an image on the cloth 400. In a heating process, after the printing process, the cassette 200 mounting the cloth 400 is removed from the printer 1 and attached to the heating device 500. The heating device 500 heats the cloth 400 and fixes the image on the cloth 400.

While the cassette 200 (e.g., a tray) serving as a cloth holder keeps mounting the cloth 400, the printer 1 prints the image on the cloth 400 and the heating device 500 fixes the image on the cloth 400 under heat, enhancing usability in forming the image on the cloth 400.

Figure 18:
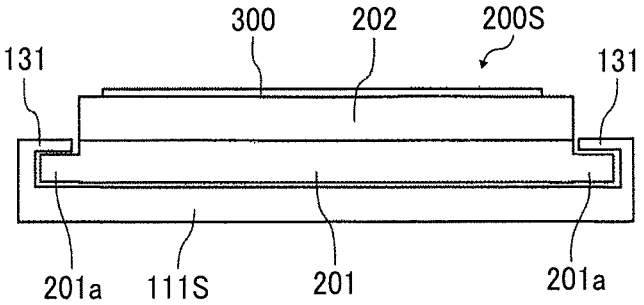
FIG. 18 is a diagram of a cassette and a stage according to a third embodiment of the present disclosure.

Referring to FIG. 18, a description is provided of a construction of a cassette 200S and a stage 111S installable in the printer 1 or 1S according to a third embodiment.

FIG. 18 is a diagram of the cassette 200S and the stage 111S.

As illustrated in FIG. 18, guide rails 131 are mounted on both lateral ends of the stage 111S in the direction perpendicular to the attachment direction DA, respectively. The cassette base 201 of the cassette 200S serving as a cloth holder includes both lateral ends 201*a* in the direction perpendicular to the attachment direction DA. The guide rails 131 are movably fitted onto or engaged with both lateral ends 201*a* of the cassette base 201 such that the guide rails 131 hold the lateral ends 201*a*, respectively.

Each of the lateral ends 201*a* of the cassette base 201 may be fitted into or engaged with the guide rail 131 entirely in the attachment direction DA. Alternatively, a projection locally disposed on each of the lateral ends 201*a* may be fitted into or engaged with the guide rail 131.

As described above, the guide rails 131 mounted on the stage 111S are movably fitted onto or engaged with the lateral ends 201*a* of the cassette 200S such that the guide rails 131 hold the lateral ends 201*a* of the cassette 200S, respectively. Thus, the guide rails 131 reduce tilting of the cassette 200S relative to the stage 111S and rattling and backlash of the cassette 200S.

According to the first embodiment described above with reference to FIG. 11, the guide rails 211 are mounted on the cassette 200. Hence, a width of the stage 111 in the direction perpendicular to the attachment direction DA is not greater than a width of the cassette 200. Conversely, according to the third embodiment illustrated in FIG. 18, a width of the stage 111S is greater than a width of the cassette 200S. Hence, the first embodiment downsizes the printer 1 or 1S more than the third embodiment.

Figure 19:
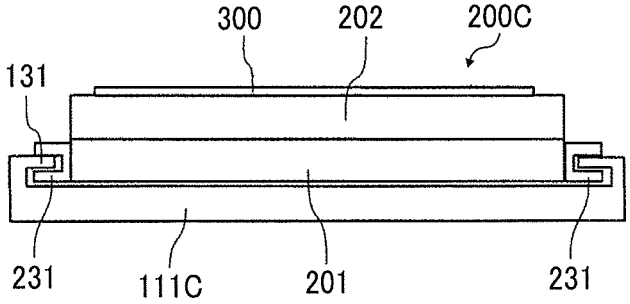
FIG. 19 is a diagram of a cassette and a stage of a comparative example.

A description is provided of advantages of the embodiments described above in view of a comparative example illustrated in FIG. 19.

FIG. 19 is a diagram of a cassette 200C and a stage 111C of the comparative example.

As illustrated in FIG. 19, the guide rails 131 are mounted on both lateral ends of the stage 111C in the direction perpendicular to the attachment direction DA, respectively. Grooves 231 are mounted on both lateral ends of the cassette 200C in the direction perpendicular to the attachment direction DA, respectively. The guide rails 131 movably engage the grooves 231 such that the guide rails 131 are movable or slidable over the grooves 231, respectively.

The grooves 231 engaging the guide rails 131, respectively, that are mounted on the stage 111C hold the cassette 200C in a state in which the cassette 200C is lifted from the stage 111C. Thus, the guide rails 131 and the grooves 231 define a position of the cassette 200C in a height direction.

Accordingly, the comparative example illustrated in FIG. 19 requests the guide rails 131 and the grooves 231 to be precisely mounted on the stage 111C and the cassette 200C, respectively, to prevent the platen 300 of the cassette 200C from being tilted.

Conversely, according to the embodiments described above, the guide rails 211 and 131 mounted on one component (e.g., the cassette 200 and the stage 111S) movably engage and hold both lateral ends 111*a* and 201*a* of another component (e.g., the stage 111 and the cassette 200S), respectively. Accordingly, the guide rails 211 and 131 define a positional relation between the cassette base 201 of the cassettes 200 and 200S and the stages 111 and 111S. Consequently, the guide rails 211 and 131 merely serve as a guide.

According to the embodiments described above, each of the printers 1 and 15 includes the cloth holder (e.g., the cassettes 200 and 200S) and the receiver (e.g., the stages 111 and 111S). Similarly, the heating device 500 depicted in FIG. 17 may include the guide rails 211 or 131 mounted on both lateral ends of one of the cloth holder (e.g., the cassettes 200 and 200S) and the receiver (e.g., the receiver 503) in the direction perpendicular to the attachment direction DA. The guide rails 211 or 131 are movably fitted into or engaged with both lateral ends of another one of the cloth holder and the receiver in the direction perpendicular to the attachment direction DA such that the guide rails 211 and 131 hold the lateral ends of the another one of the cloth holder and the receiver, respectively.

According to the embodiments described above, each of the cassettes 200 and 200S that has a box shape serves as a cloth holder. Alternatively, the cloth holder may have other shapes as long as the cloth holder is removably attached to a printer and a heating device. For example, the cloth holder may be a single platy platen inserted into the printer and the heating device.

As a method to enhance usability for printing, in order to eliminate a process in which the user sets a cloth (e.g., a T-shirt) on the cloth holder every time during printing, the user may use the cloth holder on which the cloth has been set. In this case, the cloth holder after use is collected and the cloth holder on which another cloth has been set is supplied. Thus, the cloth holder mounting a cloth and holding a print face of the cloth to be planar may be commercially available as a cloth holder with a cloth.

Alternatively, in order to attain similar advantages, the user may use a platen with a cloth, that is removably attachable to the printer and the heating device. A cloth (e.g., a T-shirt) has been set on the platen. For example, the user attaches the platen with the cloth to the cloth holder. After printing and fixing are finished, the user removes the platen with the cloth from the cloth holder. The user attaches a next platen with a cloth to the cloth holder. Printing and fixing are performed on the cloth placed on the next platen with the cloth. In this case, the platen after use is collected and the platen on which another cloth has been set is supplied. Similarly with the cloth holder with the cloth, the platen mounting a cloth and holding a print face of the cloth to be planar may be commercially available as a cloth holder with a cloth.

Accordingly, since the user need not set a cloth (e.g., a T-shirt) on the platen every time, the user readily handles a plurality of clothes continuously. Alternatively, the plurality of clothes may be automatically handled continuously.

The embodiments described above use fabric such as a T-shirt. Alternatively, the embodiments described above are applicable to media including fabric on which an image is printed and heated. In this case, the cloth used in the embodiments described above serves as a medium.

A description is provided of advantages of a fabric printing apparatus (e.g., the printers 1 and 1S) that prints an image on fabric.

As illustrated in FIGS. 3, 11, and 18, the fabric printing apparatus includes a body (e.g., the body 100), a cloth holder (e.g., the cassettes 200 and 200S), a receiver (e.g., the stages 111 and 111S), a printing device (e.g., the printing device 112), and a guide rail (e.g., the guide rails 211 and 131).

The cloth holder holds a cloth (e.g., the cloth 400) and is movable in a moving direction (e.g., the attachment direction DA). The receiver is disposed inside the body and removably holds the cloth holder. The printing device prints an image on the cloth placed on the cloth holder held by the receiver. The guide rail is mounted on both lateral ends of one of the cloth holder and the receiver in a direction perpendicular to the moving direction of the cloth holder. The guide rail is movably engaged with or fitted into both lateral ends of another one of the cloth holder and the receiver in the direction perpendicular to the moving direction of the cloth holder such that the guide rail holds the lateral ends of the another one of the cloth holder and the receiver.

Accordingly, the fabric printing apparatus is downsized and facilitates setting of the cloth on the cloth holder.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fabric printing apparatus comprising:
a body;
a cloth holder to hold a cloth, the cloth holder being movable in a moving direction;
a receiver, disposed inside the body, to removably hold the cloth holder;
a printer to print an image on the cloth on the cloth holder held by the receiver;
a guide rail mounted on both lateral ends of one of the cloth holder and the receiver in a direction perpendicular to the moving direction of the cloth holder, the guide rail to movably engage and hold both lateral ends of another one of the cloth holder and the receiver in the direction perpendicular to the moving direction of the cloth holder;
a first restraint mounted on the receiver; and
a second restraint, mounted on the cloth holder, to engage the first restraint,
wherein the first restraint and the second restraint restrict a position of the cloth holder.

2. The fabric printing apparatus according to claim 1, wherein the first restraint includes a recess and the second restraint includes an engagement to separably engage the recess.

3. The fabric printing apparatus according to claim 2, wherein the engagement includes a roller.

4. The fabric printing apparatus according to claim 2, further comprising a resilient member being mounted on the cloth holder and supporting the engagement.

5. The fabric printing apparatus according to claim 4, wherein the resilient member includes a flat spring.

6. A fabric printing apparatus comprising:
a body;
a cloth holder to hold a cloth, the cloth holder being movable in a moving direction;
a receiver, disposed inside the body, to removably hold the cloth holder;
a printer to print an image on the cloth on the cloth holder held by the receiver;
a guide rail mounted on both lateral ends of one of the cloth holder and the receiver in a direction perpendicular to the moving direction of the cloth holder, the guide rail to movably engage and hold both lateral ends of another one of the cloth holder and the receiver in the direction perpendicular to the moving direction of the cloth holder; and
a guide, disposed inside the body, to guide the cloth holder obliquely downward toward the receiver.

7. The fabric printing apparatus according to claim 6, further comprising a projection mounted on the cloth holder and guided by the guide.

8. The fabric printing apparatus according to claim 6, wherein the body includes:
a cavity; and
an interior wall mounting the guide at a height where the guide defines a distance from a top face of the guide to a top face of the cavity, and
wherein the distance is smaller than a height of the cloth holder.

9. The fabric printing apparatus according to claim 1, wherein the cloth holder includes:
a platen mounting the cloth and including a flange disposed at a rim of the platen;
a fringe cover to press the cloth against the flange; and
a slot disposed opposite the platen.

10. The fabric printing apparatus according to claim 9, wherein the cloth holder further includes:
a base; and
a hinge through which the fringe cover is attached to the base.

11. The fabric printing apparatus according to claim 6, wherein the cloth holder includes:
a platen mounting the cloth and including a flange disposed at a rim of the platen;
a fringe cover to press the cloth against the flange; and
a slot disposed opposite the platen.

12. The fabric printing apparatus according to claim 11, wherein the cloth holder further includes:
a base; and
a hinge through which the fringe cover is attached to the base.

13. The fabric printing apparatus according to claim 1, wherein the first restraint includes a recess and the second restraint includes a means for engaging to separably engage the recess.

14. The fabric printing apparatus according to claim 13, wherein the means for engaging includes a roller.

15. The fabric printing apparatus according to claim 13, further comprising a means for being resilient mounted on the cloth holder and for resiliently supporting the engagement.

16. The fabric printing apparatus according to claim 15, wherein the means for being resilient includes a flat spring.

* * * * *